United States Patent [19]

Ludwig

[11] 4,203,377

[45] May 20, 1980

[54] SEWING OF A BEAD SEAM WITH LOOSE THREAD LOOPS

[75] Inventor: Rolf Ludwig, Bielefeld, Fed. Rep. of Germany

[73] Assignee: Kochs Adler AG, Bielefeld, Fed. Rep. of Germany

[21] Appl. No.: 946,804

[22] Filed: Sep. 28, 1978

[51] Int. Cl.[2] ..... D05B 15/00
[52] U.S. Cl. ..... 112/58
[58] Field of Search ..... 112/58, 242, 243

[56] References Cited

U.S. PATENT DOCUMENTS

| | | | |
|---|---|---|---|
| 1,431,478 | 10/1922 | Miller | 112/58 |
| 2,049,369 | 7/1936 | Gouldbourn et al. | 112/58 |
| 2,928,361 | 3/1960 | Ashworth et al. | 112/58 |

*Primary Examiner*—Patrick D. Lawson
*Attorney, Agent, or Firm*—Max Fogiel

[57] ABSTRACT

In a machine for sewing together two workpiece parts by means of a bead seam, a device for providing each stitch with an additional amount of thread for forming the bead seam with loose loops, e.g. in order to produce moccasin footwear having a flattened bead seam as demanded by the fashion. Means are provided to disengage the loop forming device for producing a regular bead seam.

6 Claims, 10 Drawing Figures

Fig. 2
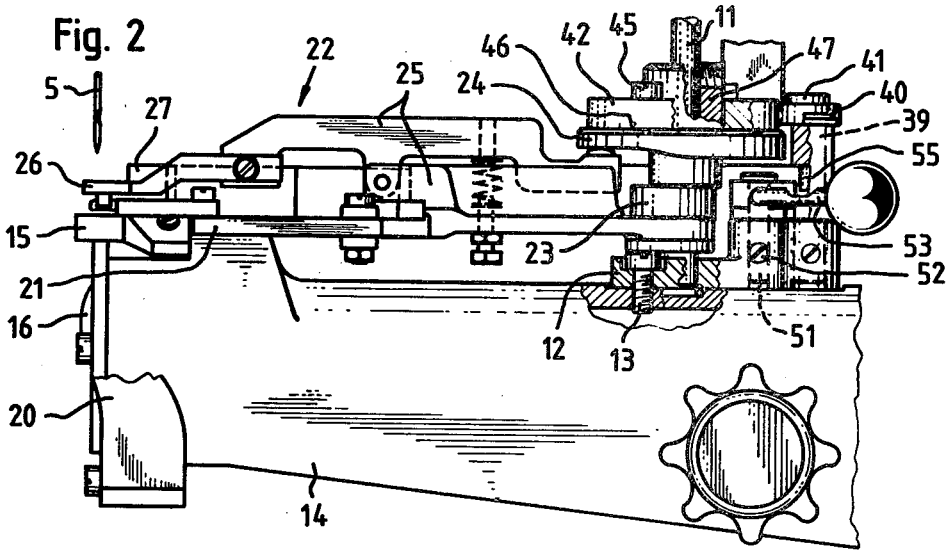
Fig. 3
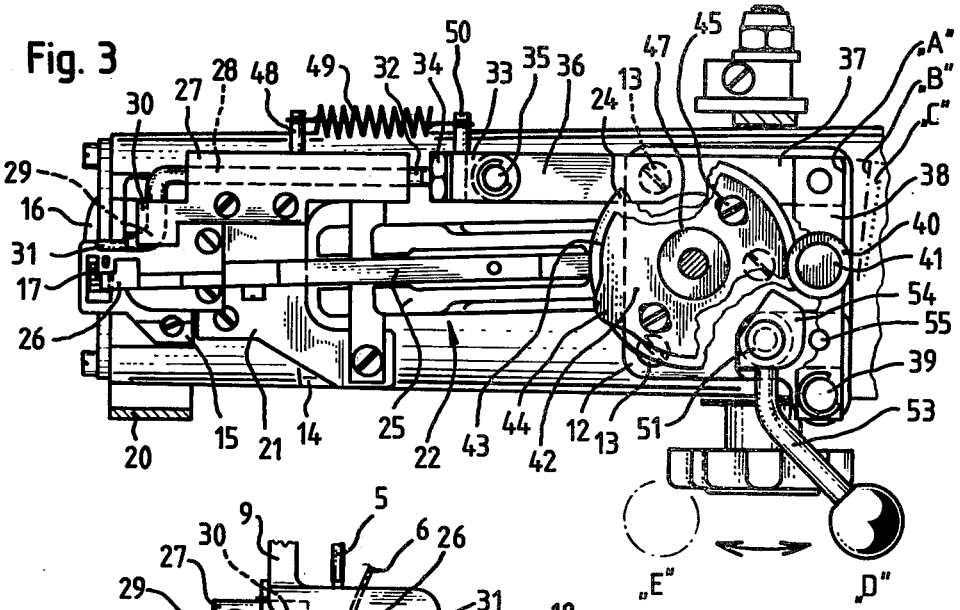
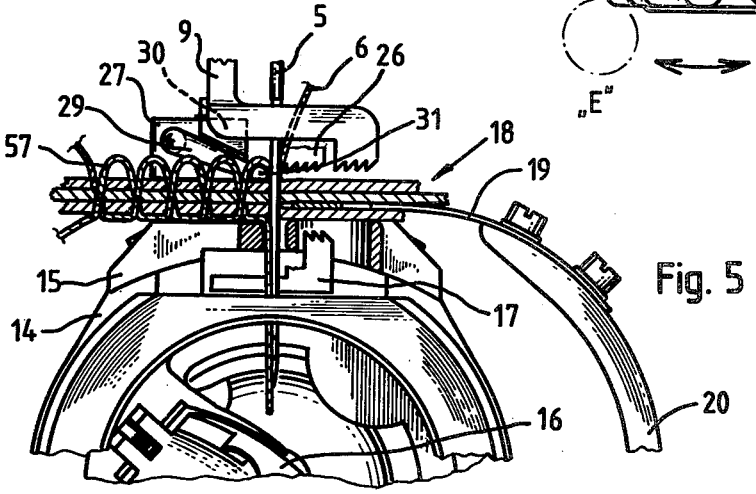
Fig. 5

SEWING OF A BEAD SEAM WITH LOOSE THREAD LOOPS

BACKGROUND OF THE INVENTION

The invention relates to an additional outfit of sewing machines for sewing together two workpiece parts by means of a bead seam as presented in the pending patent application Ser. No. 875,417, filed Feb. 6, 1978. This type of machine is suited for joining workpiece parts by means of a bead seam, at which ruffling may become necessary, too, e.g. at moccasin shoe parts. In order to provide a fluid-tight connection of the two workpieces, the bead itself of such a produced beam seam is strongly marked by the fastened stitch formation.

In opposite to this type of moccasin shoe provided with a strongly marked beam seam, there is another type of moccasin shoe provided with a flattened less marked bead seam on the market, accordingly to fashion's demand. The operation of bead seam flattening takes place while the steam-treated shoe upper is pulled over the shoe last and the beam seam is stretched to a flat configuration. In order to allow this flattening, an additional amount of thread of each stitch is required and obviously such a moccasin shoe does not have the aforesaid fluid-tightness.

As described in the above cited pending patent application, the conventional method of making moccasin shoes by hand is very expensive and time consuming. Now, with the additional requirements of providing an additional amount of thread to each stitch, this manual procedure becomes even more complicated and hardly to perform. The main problem presents the provision of an equal amount of thread to each stitch, in order to achieve an uniformly flattened bead seam having an equalized strength.

SUMMARY OF THE INVENTION

Accordingly, it is an object of the present invention to provide a sewing machine for sewing together two workpiece parts by means of a bead seam with means for providing each stitch with an additional amount of thread to allow a stretching of the bead seam to a flat configuration.

It is further an object of this invention to provide a sewing machine for sewing together shoe parts such as a vamp and a plug of a moccasin shoe by means of a bead seam, at which ruffling becomes necessary, with a mechanism to provide each stitch with an additional amount of thread to allow a bead flattening in the shoe lasting operation.

It is another object of this invention to create a sewing machine with a mechanism for the provision of an additional amount of thread of simple design and handling.

It is still another object to install a sewing machine with the aforesaid mechanism that assures the provision of a constant amount of thread to each stitch.

Another object of this invention is to install a sewing machine with a thread providing mechanism as aforesaid, at which the adjustment of the needle-thread tension does not affect the amount of the provided additional thread.

It is still another object of this invention to provide a machine of the aforesaid type with readily operatable shifting means for sewing together a vamp and a plug of a moccasin shoe either by means of a strongly marked bead seam or by means of a bead seam provided with an additional amount of thread to allow a bead seam flattening in the lasting operation.

These and other objects of the invention will become apparent from the specific description in connection with the drawings of a preferred embodiment and the appended claims.

BRIEF DESCRIPTION OF THE DRAWINGS

In the drawings

FIG. 2 is an enlarged partial view of FIG. 1 showing the supporting arm of the sewing machine with the preferred embodiment of the invention;

FIG. 3 is a plan top view of the work supporting arm corresponding to FIG. 2;

FIG. 5 shows a partial side view in direction V of FIG. 4 of the supporting arm including a sectional view of the workpiece parts and the stitch formation;

DESCRIPTION OF THE PREFERRED EMBODIMENT

Figure 1:
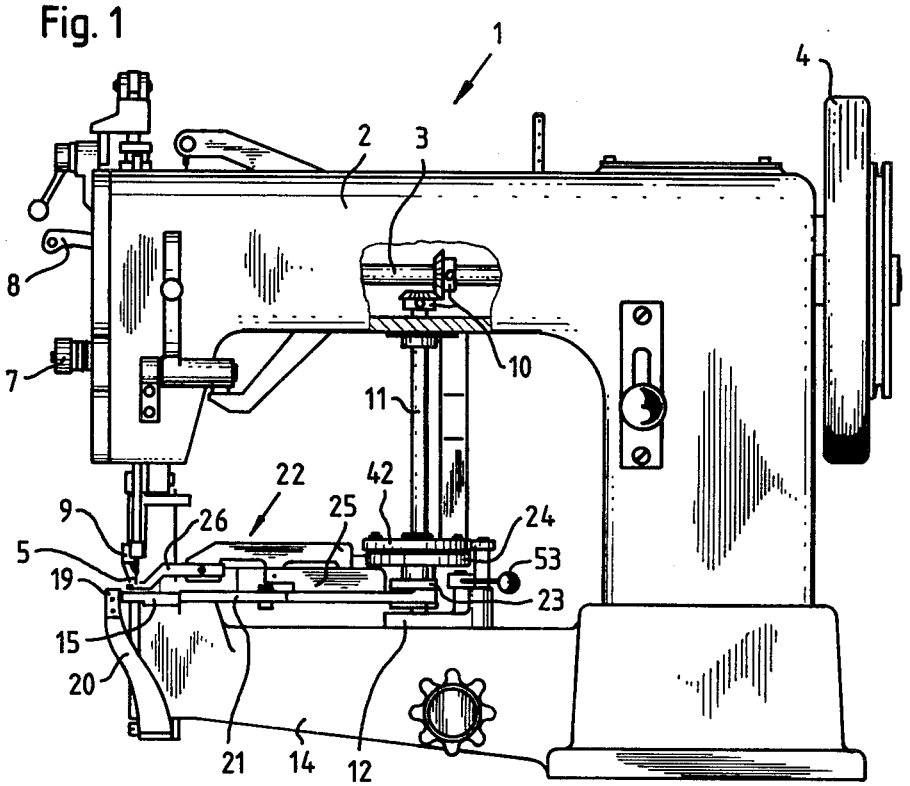
FIG. 1 is a front view of a sewing machine provided with means according to the present invention.

Referring more particularly to the drawings, in FIG. 1 there is shown a sewing machine 1 of a heavy type as described in detail in the aforesaid pending patent application, and which is provided with a bracket arm 2 for receiving an arm shaft 3 provided with a hand wheel 4, a reciprocating needle 5 carrying a needle thread 6 (FIGS. 8 to 10) guided and tensioned by a thread tension 7 (FIG. 1), a thread-take-up lever 8 and an upper feed dog 9. The arm shaft 3 drives by means of a pair of bevel gears 10 a vertical shaft 11, the free end of which is pivotally received in a bearing 12 mounted by screws 13 to a supporting arm 14 carrying a throat plate 15 (FIGS. 2 and 3).

Figure 4:
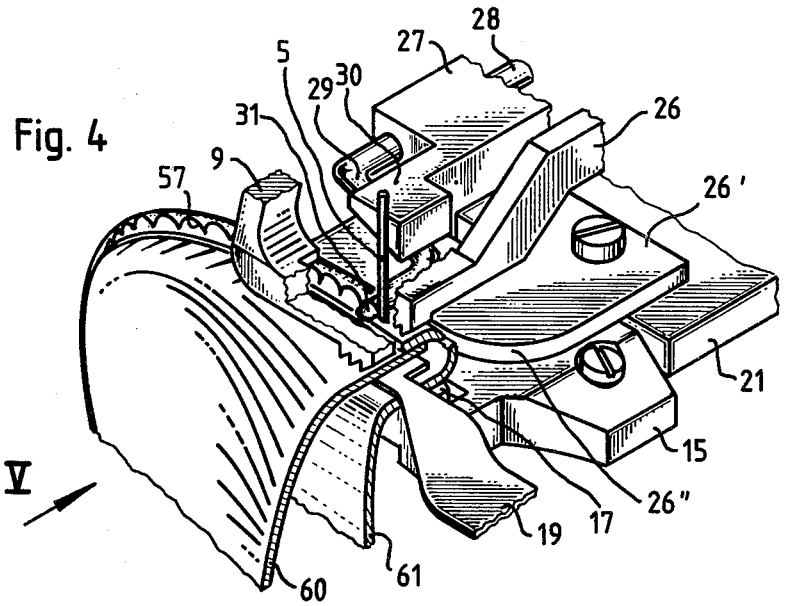
FIG. 4 represents a partial perspective front view of the supporting arm with a section of a sewn moccasin shoe upper according to the invention.

Within the supporting arm 14 there are drive parts to operate a barrel-type hook 16 and a feed dog 17 acting on workpiece parts 18, two of which are separated by an intermediate member 19 secured to a bracket 20 (FIG. 5). On the supporting arm 14 there is arranged a plate 21 (FIGS. 1 to 4) for receiving a bead seam forming device 22 which essentially consists of an eccentric 23 and an axial cam 24 both secured to the vertical shaft 11, and connecting parts 25 for imparting movements of a folding finger 26 which synchronously operates in front of the needle 5 in connection with an edge guide 26′ provided with a forming edge 26″ (FIG. 4).

The plate 21 further carries a bearing 27 (FIGS. 3 and 4) for slidably receiving a rod 28 presenting a loop supporting member 29, which is laterally guided by a projecting portion 30 (FIGS. 3 to 5) of the bearing 27, and the one end of which operates as a finger-formed and profiled end part 31 behind the needle 5. The other end of the rod 28 is provided with a thread 32 for receiving a clevis 33 secured by a lock nut 34 linked by means of a bolt 35 to a transmitting bar 36, the free end 37 of which is jointly connected to a rocking lever 38 pivotally received in the bearing 12 by means of a bolt 39 (FIGS. 2 and 3). The rocking lever 38 carries a cam follower 40 secured to it by a bolt 41 for transmitting movements imparted by a radial cam 42 provided mainly with a concentric runway 43 for dwelling and a cam lobe 44 for movements, adjustably fastened by screws 45 on the plane surface 46 and guidingly received by a hub 47 of the axial cam 24. In order to assure abutting of the cam follower 40 against the radial cam 42, the bearing 27 carries a pin 48 for supporting a spring 49 acting on a pin 50 located at the clevis 33. Furthermore, there is a shifting lever 53, which is pivoted on a bolt 51 received in the bearing 12 and secured by a set screw 52. The shifting lever 53 is provided with a cam 54 which cooperates with a pin 55 fastened to the rocking lever 38.

The operation can be described as follows in connection with FIGS. 1 to 3 and 8 to 10:

The arm shaft 3 drives the vertical shaft 11 including the axial cam 24 and the radial cam 42 secured thereto. As the radial cam 42 rotates, the cam lobe 44 forces the rocking lever 38 with its cam follower 40 to move from a position "A" to a position "B" (FIG. 3). These oscillating movements are transferred to the finger-formed and profiled end part 31.

Figure 8:
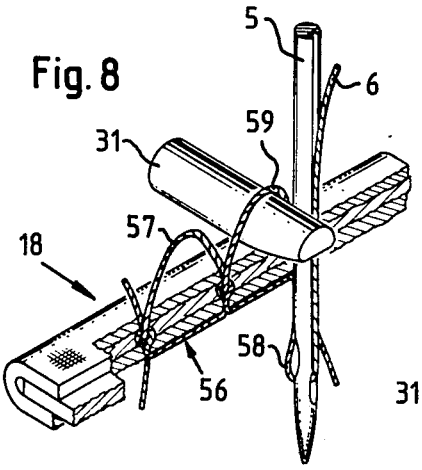
FIGS. 8 to 10 are schematic perspective views of a sequence of stitch and loop formations according to the invention.
Figure 9:
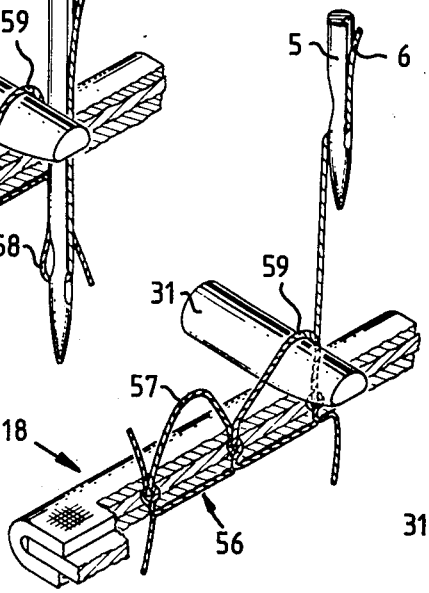

Considering now in detail the formation of a stitch 56 having a loop 57, FIG. 8 shows the needle 5 on its upward motion about in the instant to form a loop 58 of the needle thread 6, which is to be caught by the beak of the hook (not shown). At this moment, the finger-formed and profiled end part 31 is in an active position referring to position "A" (FIG. 3) of the rocking lever 38 for supporting the loop 59 against the thread draw caused by the hook. As the needle 5 proceeds its motion up and after reaching the upper dead center reversing its movement, the thread-take-up lever 8 reaches its upper dead center, in order to tighten the last performed stitch. Up to this moment (shown in FIG. 9), the finger-formed and profiled end part 31 still is in position "A" as referred to, regardless of the workpiece advance carried out by the feed dogs 9, 17 (FIGS. 4 and 5).

Figure 10:
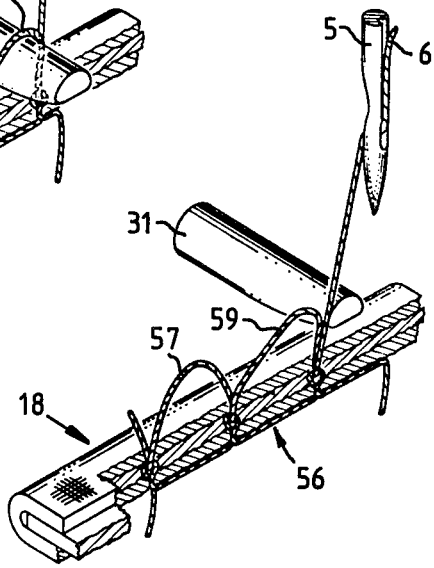

Next in sequence, the needle 5 performs its downward motion and shortly before the needle 5 penetrates the workpiece parts 18, the cam lobe 44 of the radial cam 42 cooperating with the cam follower 40 causes the rocking lever 38 to move into position "B" (FIG. 3) as to withdraw the finger-formed and profiled end part 31 into a position for releasing the loop 59 (FIG. 10).

Figure 7:
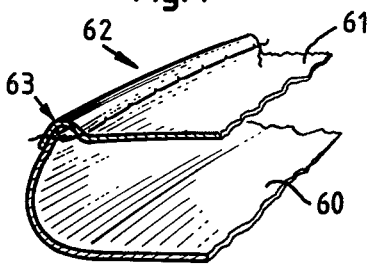
FIG. 7 is a fragmentary perspective view of a cut-off of a moccasin shoe having a flattened less strongly marked bead seam.

The described stitch formation applied to joining a vamp 60 and a plug 61 of a moccasin shoe by a bead seam allows to stretch the stitched bead seam resulting in a moccasin shoe 62 characterized by a flattened bead seam 63 as illustrated in FIG. 7.

Figure 6:
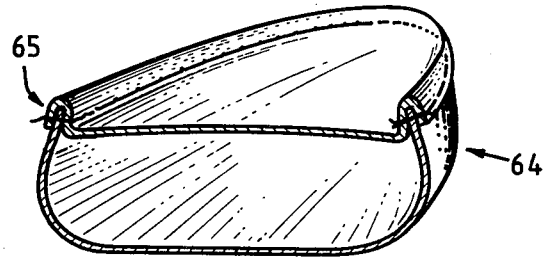
FIG. 6 is a fragmentary perspective view of a moccasin shoe provided with a strongly marked bead seam.

In order to also produce a moccasin shoe 64 (FIG. 6) provided with a strongly marked bead seam 65 on the same sewing machine 1, the action of the finger-formed and profiled end part 31 can be rendered inoperative. For this purpose, the operator shifts the shifting lever 53 (FIG. 3) from position "D" to "E", by which the rocking lever 38 is pushed into position "C", so that the cam follower 40 is out of the effective range of the cam lobe 44.

What is claimed is:

1. In a sewing machine for sewing together two workpiece parts by means of a bead seam, means for providing each stitch with an additional amount of thread for forming said bead seam with loose loops, said means comprising: a loop supporting member located behind the needle of said sewing machine and in the path of stitch formation, and means for imparting loop releasing motions to said loop supporting member after each stitch formation; the motion of said loop supporting member serving only for loop releasing motion and being free of thread measurement.

2. In a sewing machine as claimed in claim 1, wherein said loop supporting member consists of a rod provided with a finger-formed and round profiled end part for supporting and forming said additional amount of thread to a loop by means of said needle and in connection with the feed of said workpiece parts.

3. A sewing machine as claimed in claim 1, wherein said needle is driven by an arm shaft and said means for imparting loop releasing motions to said supporting member after each stitch formation comprises: a shaft driven by said arm shaft; a cam secured to said shaft; a cam follower; a rocking lever carrying said cam follower; a transmitting bar linked between said rocking lever and said loop supporting member, and a spring for abutting said cam follower against said cam.

4. In a sewing machine as claimed in claim 1, means for disengaging said loop supporting member out of said path of stitch formation in an inoperative position.

5. In a sewing machine having a housing including a bracket arm and a supporting arm; an arm shaft pivoted in said bracket arm; a needle driven by said arm shaft; a throat plate fastened to said supporting arm; a feed dog operating within said throat plate, and means for forming the protruding relatively short edge of a plug about the relatively long edge of a vamp of a moccasin shoe to a bead seam, including an edge guide having a forming edge for prefolding the protruding short edge of said plug; an intermediate member between said plug and said vamp and arranged in front of said needle; a folding finger located in front of said needle, cooperating with said intermediate member for folding said prefolded protruding edge of said plug about said edge of said vamp and imparting longitudinal work compressing motions; an upper feed dog cooperating with said edge guide, said folding finger and said intermediate member and imparting work compressing motions to said relatively long edge of said vamp, and means for actuating said folding finger including: an axial cam for imparting vertical motions to said folding finger; an eccentric for moving said folding finger in a horizontal plane, and a vertical shaft carrying said axial cam and said eccentric driven by said cam shaft; means for providing each stitch with an additional amount of thread for forming loose loops on one side of said beam seam, comprising: a loop supporting member consisting of a rod provided with a finger-formed and round profiled end part located behind said needle and in the path of stitch formation; means for imparting loop releasing motions to said loop supporting member after each stitch formation, including: a radial cam driven by said vertical shaft; a rocking lever pivotally received on said supporting arm; a cam follower received on said rocking lever; a transmitting bar linked to said rocking lever and said rod, and a spring for abutting said cam follower against said radial cam; and means for disengaging said loop supporting member out of said path of stitch formation in an inoperative position including a cam; a shifting lever for actuating said cam; and a pin located at said rocking lever for cooperating with said cam.

6. In a sewing machine as claimed in claim 1, including a rod having a finger-formed and round profiled end part; a radial cam driven by a vertical shaft; a rocking lever pivotally received on a supporting arm; cam follower means received on said rocking lever; a transmitting bar linked to said rocking lever and said rod, and spring means for abutting said cam follower against said radial cam.

* * * * *